United States Patent [19]

Fleischer

[11] 3,970,221

[45] *July 20, 1976

[54] APPLICATOR SYSTEM FOR FLUIDS

[76] Inventor: Barry Fleischer, 16170 Roanoke, Southfield, Mich. 48075

[ * ] Notice: The portion of the term of this patent subsequent to Apr. 29, 1992, has been disclaimed.

[22] Filed: Jan. 14, 1975

[21] Appl. No.: 540,791

Related U.S. Application Data

[62] Division of Ser. No. 349,751, April 10, 1973, Pat. No. 3,880,333.

[52] U.S. Cl. ..... 222/145

[51] Int. Cl.² ..... B67D 5/60

[58] Field of Search ..... 239/372, 527, 414, 415; 222/148, 399, 400.7, 402.18, 402.24

[56] References Cited

UNITED STATES PATENTS

| | | | |
|---|---|---|---|
| 1,361,527 | 12/1920 | Johns | 230/527 X |
| 3,006,559 | 10/1961 | Schmidt | 239/414 |
| 3,033,472 | 5/1972 | Shelton | 239/527 X |
| 3,179,341 | 4/1965 | Plos et al. | 239/414 |
| 3,341,082 | 9/1967 | Meshberg | 222/402.18 |
| 3,352,333 | 11/1967 | Glasgow et al. | 239/415 X |
| 3,604,602 | 2/1969 | Lee | 222/400.7 |
| 3,658,254 | 4/1972 | Lee | 239/372 |
| 3,708,123 | 1/1973 | Kruger | 239/527 |
| 3,880,333 | 4/1975 | Fleischer | 222/402.18 |

*Primary Examiner*—Stanley H. Tollberg
*Assistant Examiner*—Norman L. Stack, Jr.
*Attorney, Agent, or Firm*—Basile and Weintraub

[57] ABSTRACT

A spray applicator system for dispensing a bulk fluid, such as, hair lacquers, wave set lotions and the like, includes a source of compressed air, a source of fluid, and an applicator. Valve means for delivering the liquid under pressure from the source thereof to the application are also included within the system. The present system provides an air current preceding and following dispensing of the fluid from the applicator to purge the applicator of any residual fluid, thus maintaining the chambers within the applicator in a cleansed state.

6 Claims, 4 Drawing Figures

APPLICATOR SYSTEM FOR FLUIDS

This is a division of application Ser. No. 349,751, filed Apr. 10, 1973 now U.S. Pat. No. 3,880,333.

BACKGROUND OF THE INVENTION

1. Field of the Invention

The present invention relates to applicator systems for fluids and in particular to spray applicator systems for bulk fluids. More particularly, the present invention relates to an applicator system for bulk fluids including a unique spray gun applicator, valve means for delivering the fluid from the source thereof to the applicator under pressure and a source of pressure. Even more particularly the present invention pertains to an applicator system for delivering a bulk fluid, wherein an air current precedes and follows the dispensing of the fluid to maintain the system purged of any residual fluids from the applicator.

2. Prior Art

There has been described heretofore a plurality of applicator systems for delivering bulk fluids to a spray applicator, wherefrom the fluid is dispensed to an external environment. Such systems have particular utility in cosmetology application, such as, dispensing of hair lacquers, wave set lotions, and the like. However, such systems are inherently defective because the fluid dispensed by such systems tends to build up residuals within the delivery system so that clogging occurs.

Because of the organic nature of the fluids used in such systems, the clogging cannot be easily corrected. This, necessitates either replacement, down-time for cleaning, or other expensive maintenance.

The present invention, alternatively, seeks to overcome these problems with a unique system whereby an air current purges the system of any residual fluid.

SUMMARY OF THE INVENTION

In accordance with the present invention, there is provided a spray applicator system which generally includes a pressure source, a source of bulk fluid, and means for delivering the fluid under pressure to an applicator which dispenses or discharges the fluid to the atmosphere.

The means for delivering the fluid includes a valve means interposed in the system. The valve means through which the source of fluid is pressurized, also, interconnects the source of fluid with an applicator, as well as diverts a portion of the pressurizing med to the applicator.

The applicator is designed such that a current of pressurizing medium precedes and follows any charge of fluid which is dispensed to the atmosphere through the applicator. By having the pressurizing medium precede and proceed the fluid charge, any residual fluids are completely purged from the applicator, thereby, eliminating a costly maintenance item.

For a complete discussion of the present invention, reference is made to the following detailed description and accompanying drawing. In the drawing, like reference characters refer to like parts throughout the several views in which:

DESCRIPTION OF PREFERRED EMBODIMENTS

Figure 1:
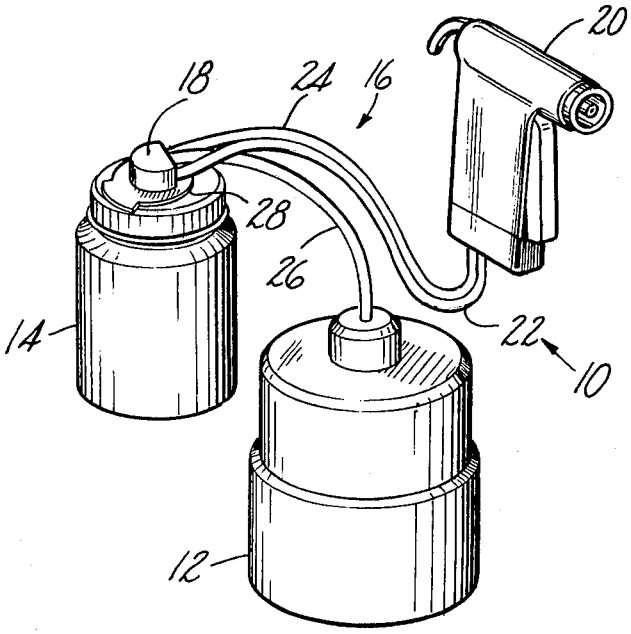
FIG. 1 is a perspective view of the system of the present invention.

With reference to the drawing, and in particular FIG. 1, the present system generally indicated 10, includes a source of pressurizing medium 12, a source of bulk fluid or fluid dispenser or container 14, and means 16 for delivering the fluid, under pressure, to the atmosphere. The means 16 for delivering the fluid includes a valve 18 interposed in the system 10. The means 16 further includes on applicator 20.

As will be subsequently detailed, the valve means 18 provides fluid communication between (a) the source of pressurizing medium 12 and the source of fluid 14, (b) the source of fluid 14 and the applicator 20, and (c) between the source of pressurizing medium 12 and the applicator 20. The valve means 18 is in fluid communication or interconnected with the applicator 20 through conduits 22 and 24. The source of pressurizing medium 12, is in fluid communication with the valve means 18 through conduit 26.

With more particularity now, the source of pressurizing medium 12 comprises any conventional compressor, such as, an air compressor or the like. Such compressors are well known in the art, and any such conventional compressor can be utilized in the practice of the present invention. Generally, though, a compressor delivering compressed air having a pressure of from 12 to 15 psig is necessary to be effective herein.

The dispenser 14 comprises any suitable container in which can be stored a bulk fluid, such as, hair lacquer, wave set lotion, or other bulk fluid.

The dispenser 14 includes an aperture 28 providing access into the interior thereof, as shown in FIG. 1. The aperture 28 also receives the valve means 18.

Figure 4:
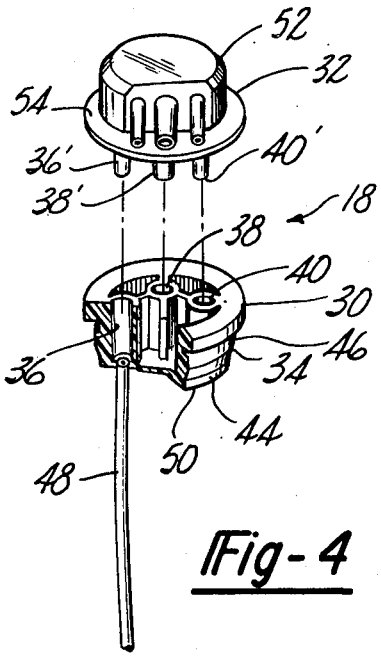
FIG. 4 is an exploded view, partly in section, of the valve means of the present invention.

Referring now to FIG. 4, there is depicted therein in greater detail the valve means 18. The valve means 18 includes a first member 30 and a second member 32 which matingly engages the first member 30.

The first member 30 comprises a solid cylindrical body 34, having a plurality of plenums 36, 38, 40, formed therethrough. The member 30 further includes a rim which seats atop the dispenser 14, and a main body 44 which is configured to sealingly engage the periphery of the aperture 18 and be disposed within the interior of the source of fluid 14. An annular recess 46 formed in the main body 44 sealingly engages the edge of the aperture 28. The main body 44 sealingly engages the interior of the dispenser proximate the periphery of the aperture 28. It is to be understood, though, that the invention is not limited to this precise configuration. Rather, this configuration is merely illustrative of the type of configuration which can be afforded the first member 30 to sealingly engage the opening of the source of fluid 14.

Still referring to FIG. 4, a fluid delivery conduit 48 downwardly depends from lower surface 50 of the first member 30. The conduit 48 provides fluid communication between the fluid disposed within the dispenser 14 and the plenum associated therewith, and as shown in FIG. 4, plenum 40.

The second member 32 or male member of valve means 18 comprises a plurality of conduits or valve stems 36', 38', and 40'. Each of these valve stems telescope into and within, respective plenums 36, 38, 40 formed in the first member 30. The conduits 36', 38', and 40' provide means for facilitating delivery of both fluid and air from the source of fluid 14 to the applicator 20. The member 32 is formed as an integral unit and further includes a cap 52, having a rim 54 integrally formed therewith. The rim 54 engages the top surface 34 of the first member 30 when the stems are inserted into and within their respective plenums.

The valve means 18 works in the following manner: A first stem and plenum, shown as 38 and 38', is connected to the source of pressurizing medium 12 through connecting line or conduit 26 (FIG. 1). The pressurizing medium delivered therethrough acts to pressurize the fluid within the source 14. The pressure exerted by the medium displaces the fluid up through conduit 48 and into plenum and stem 40, 40', for delivery to the applicator 20 through conduit 24.

A portion of the pressurizing medium is, also, diverted through plenum and stem 36, 36' which is then delivered to the applicator 20 through conduit 22. Thus, it is apparent, that both pressurizing medium and fluid are delivered to the applicator 20 through conduits 22 and 24 simultaneously.

Figure 2:
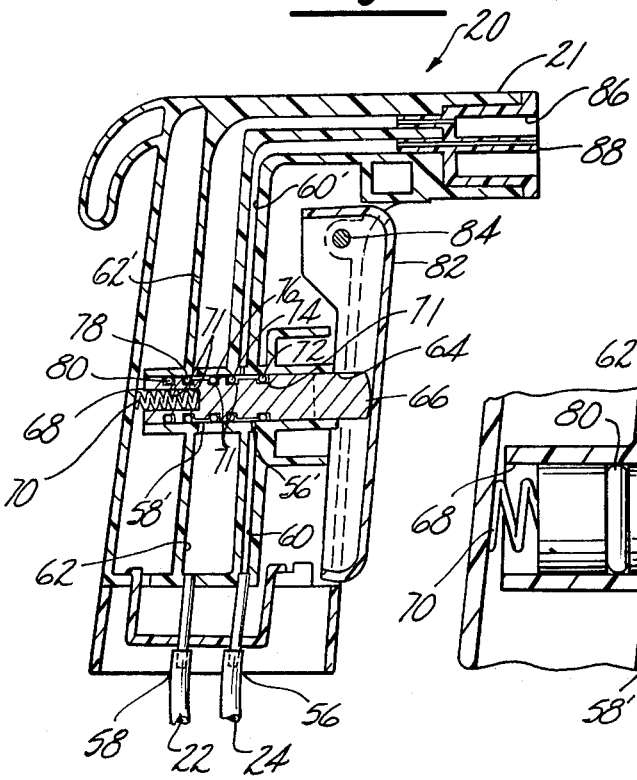
FIG. 2 is a cross-sectional view of the applicator of the present invention.
Figure 3:
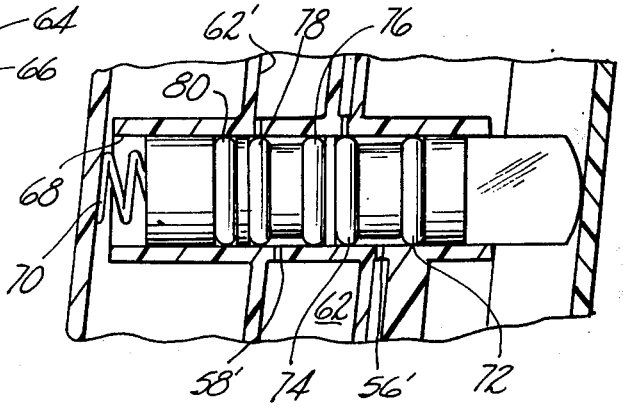
FIG. 3 is a partial cross-sectional view of the applicator of the present invention at the medial portion thereof.

Referring now to FIG. 2 and 3, there is depicted therein the applicator 20 contemplated for use in the present invention. The applicator 20 is generally an integrally molded unit formed from a suitable resinous material, such as ABS resin, which is non-reactive with organic fluids or the like. This avoids any chemical reaction between the fluids and the applicator.

The applicator 20 generally comprises a housing 21 having a first inlet 56 which is a fluid inlet, and a second inlet 58 which is a pressurizing medium inlet. The respective inlets communicate with the source 14 through the valve means 18 via the conduits 22 and 24, as shown. The inlet 56 opens into storage chamber 60 which stores fluid. The chamber 60 is provided with outlet 56' which opens into a housing 64. The inlet 58 is in communication with channel 62 which serves to store pressurizing medium. The channel 62 is provided with outlet 58' which, likewise, opens into housing 64.

The chamber 60 is in fluid communication with offset chamber 60'. The channel 62 is in fluid communication with offset channel 60'. It is critical to the practice of the present invention that the respective chambers 60, 60' and channels 62, 62' be offset from one another. The reason for this will become apparent hereinafter. However, in essence this allows controlled feeding of the chambers which in turn permits a first flow of pressurizing medium, a second flow of fluid followed by a subsequent flow or charge of pressurizing medium which permits purging of the system of any residual fluid.

Traversing the chambers and the channels, is the internal transverse housing 64 which cooperates to provide fluid communication, between the chamber 60, 60' and channels 62, 62' via inlets 57' and 59' and outlets 56' and 58'. Disposed within the housing is piston or spool 66. The spool 66 is axially slidable within the housing 64. The rear portion of the spool 66 has a bore 68 provided therein. Biassing means 70, such as a spring member or the like, is mounted within the bore 68. The biassing means 70, normally urges the spool in the direction of the arrow, as shown.

A plurality of annular grooves 71 are disposed about the periphery of the spool 66, as shown. Fitted within each of the annular grooves 71 is an O-ring seal 72, 74, 76, 78, and 80. The O-ring seals prevent fluid flow from the chamber 60 and the channel 62 into their corresponding outlet channel and chamber 60' and 62' when the spool is in its normal position.

The chambers and channels are opened into fluid communication via a trigger 82. The trigger 82 is rotationally mounted to the applicator 20 via hinge pin 84, as shown. By urging the trigger 82 towards the rear of the applicator 20, via manual means, the forces exerted thereby urge against the biassing means 70, thereby causing the spool 66 to move in a direction opposite to that of the arrow.

Because of the configuration and disposition of the O-ring seals, the O-ring seal 78 moves away from inlet and outlet 58 and 58' first, thereby, opening the channel 62 into communication with the channel 62'. This causes a flow of pressurizing medium, e.g. compressed air, to flow through the applicator 20. Further movement of the spool 66 against the force of the biassing means 70 then causes O-ring seal 74 to move away from the chamber 60, thereby providing communication between the chamber 60 and the upper chamber 60 in a manner similar to that for channels 62 and 62', thus permitting flow of fluid under pressure in a quick acting, pulsating manner.

Upon release of the trigger 82, the spool 66 moves such that the O-ring seal 74 closes off communication between the chamber 60 and the upper chamber 60', thus ceasing fluid flow. The last seal to become positioned for sealing off communication is seal 78. Because seal 78 is the last seal to become emplaced, after flow of fluid ceases pressurizing medium still continues to flow from the channel 60 into the upper channel 62'. This residual flow of medium causes the applicator system to be expunged of any residual fluid, thereby maintaining the system free from any residual buildup and clean at all times.

The upper chamber 60' and the upper channel 62' each terminate in a mixing head 86. In the mixing head, turbulence from the flow causes the liquid and the air to be intimately and homogeneously mixed. From the mixing head, either pressurizing medium, fluid, or a mixture thereof, is released into the atmosphere through nozzle 88.

It is apparent also that by extending the upper chamber 60' into direct communication with the nozzle 88 only fluid can be forced through the nozzle. This would eliminate the need for a mixing chamber since the flow would then be solely pressurizing medium, fluid and then pressurizing medium. This is efficacious where wave set lotions or the like are sought to be applied. In such instances there is no need to intimately mix the medium and the fluid.

It is further contemplated according to the present invention, that means be provided on the applicator to prevent, in those instances where undesired, movement of the trigger. This can be effectuated by providing a latching mechanism at the rear of the spool which would thereby prevent the actual movement of the spool.

Having thus described my invention, what is claimed is:

1. An applicator for dispensing a fluid under pressure, comprising:

a. a housing, b. a first channel for storing a pressurizing medium formed within the housing, the channel having an inlet and an outlet, c. an upper channel formed in the housing having an inlet thereinto and an outlet, the inlet of the upper channel being laterally displaced from the outlet of the first channel, d. a first chamber for storing a fluid formed within the housing, the chamber having an inlet and an outlet, e. an upper chamber formed in the housing having an inlet thereinto and an outlet, the inlet of the upper chamber being laterally displaced from the outlet of the first chamber, f. an internal transverse housing separating the first chamber from the upper chamber and their, respective, outlet and inlet, g. axially slidable means disposed in the internal transverse housing, h. a plurality of sealing means associated with the axially slidable means for normally sealing off fluid communications between the first chamber and the upper chamber through their respective outlets and inlets and the first channel and the upper channel through their respective outlet and inlet, i. quick action means including biasing means for pulsatingly regulating the flow out of the applicator such that there is a first flow of pressurizing medium, a second flow of fluid, and a final flow of pressurizing medium, said means for regulating being disposed in the internal transverse housing, and wherein movement of said sealing means provides fluid communication between the first chamber and the first channel and upper channel.

2. The applicator of claim 1 wherein the channels have a volume substantially greater than that of the chambers.

3. The applicator of claim 1 wherein the means for sealing off fluid communication comprises: (a) an axially slideable spool, the spool having the plurality of sealing rings disposed about the periphery thereof for sealing off communication between the chamber and upper chamber and the channel and the upper channel, and (b) the biassing means urging said sealing means into normally sealing off position, the means for sealing off fluid communication defining the means for regulating the flow.

4. The applicator of claim 3 which further comprises:

a. a mixing head disposed at the terminal point of the upper chamber and the upper channel, and b. a trigger for axially moving the spool against the force of the biassing means.

5. The applicator of claim 3 which further comprises:

a trigger for axially moving the spool against the force of the biassing means.

6. The applicator of claim 3 wherein the spool is moved such that fluid communication between the first channel and the upper channel is effected before fluid communication between the first chamber and the upper chamber, and when the spool is returned to its normal position, the first chamber and upper chamber are sealed prior to the first channel and upper channel.

* * * * *